US005601242A

United States Patent [19]

Andersen

[11] Patent Number: 5,601,242

[45] Date of Patent: Feb. 11, 1997

[54] ROLLER PRESS

[75] Inventor: Knud T. Andersen, Copenhagen, Denmark

[73] Assignee: F. L. Smidth & Co. A/S, Denmark

[21] Appl. No.: 500,964

[22] PCT Filed: Apr. 7, 1994

[86] PCT No.: PCT/EP94/01070

§ 371 Date: Jul. 24, 1995

§ 102(e) Date: Jul. 24, 1995

[87] PCT Pub. No.: WO94/23840

PCT Pub. Date: Oct. 27, 1994

[30] Foreign Application Priority Data

Apr. 13, 1993 [DK] Denmark ..... 421/93

[51] Int. Cl.[6] ..... B02C 4/32

[52] U.S. Cl. ..... 241/230

[58] Field of Search ..... 241/290, 230, 241/231, 234, DIG. 30

[56] References Cited

U.S. PATENT DOCUMENTS 3,001,390 9/1961 Zimmer ..... 241/231 X

FOREIGN PATENT DOCUMENTS

| | | | |
|---|---|---|---|
| 084383 | 9/1983 | European Pat. Off. . | |
| 1189361 | 3/1965 | Germany | 241/231 |
| 1236307 | 3/1967 | Germany . | |
| 1757093 | 3/1971 | Germany . | |
| 654793 | 6/1951 | United Kingdom . | |

*Primary Examiner*—Mark Rosenbaum

*Attorney, Agent, or Firm*—Brumbaugh, Graves, Donohue & Raymond

[57] ABSTRACT

A roller press (1; 11) for grinding of granular material and comprising two or more rollers (3, 5; 13, 14, 15) alternately rotating in opposite directions, of which at least one is displaceable in a guideway (7; 16, 17) and where only some of the rollers (5; 14) are connected to a driving means. According to the invention the guideway for each of the displaceable rollers is provided so that it is substantially parallel to the resultant force on that roller. As a result, virtually all of the resultant force acting on the displaceable roller will be acting substantially eliminating the reaction force at right angles to the guideway.

4 Claims, 2 Drawing Sheets

ROLLER PRESS

Figure 1:
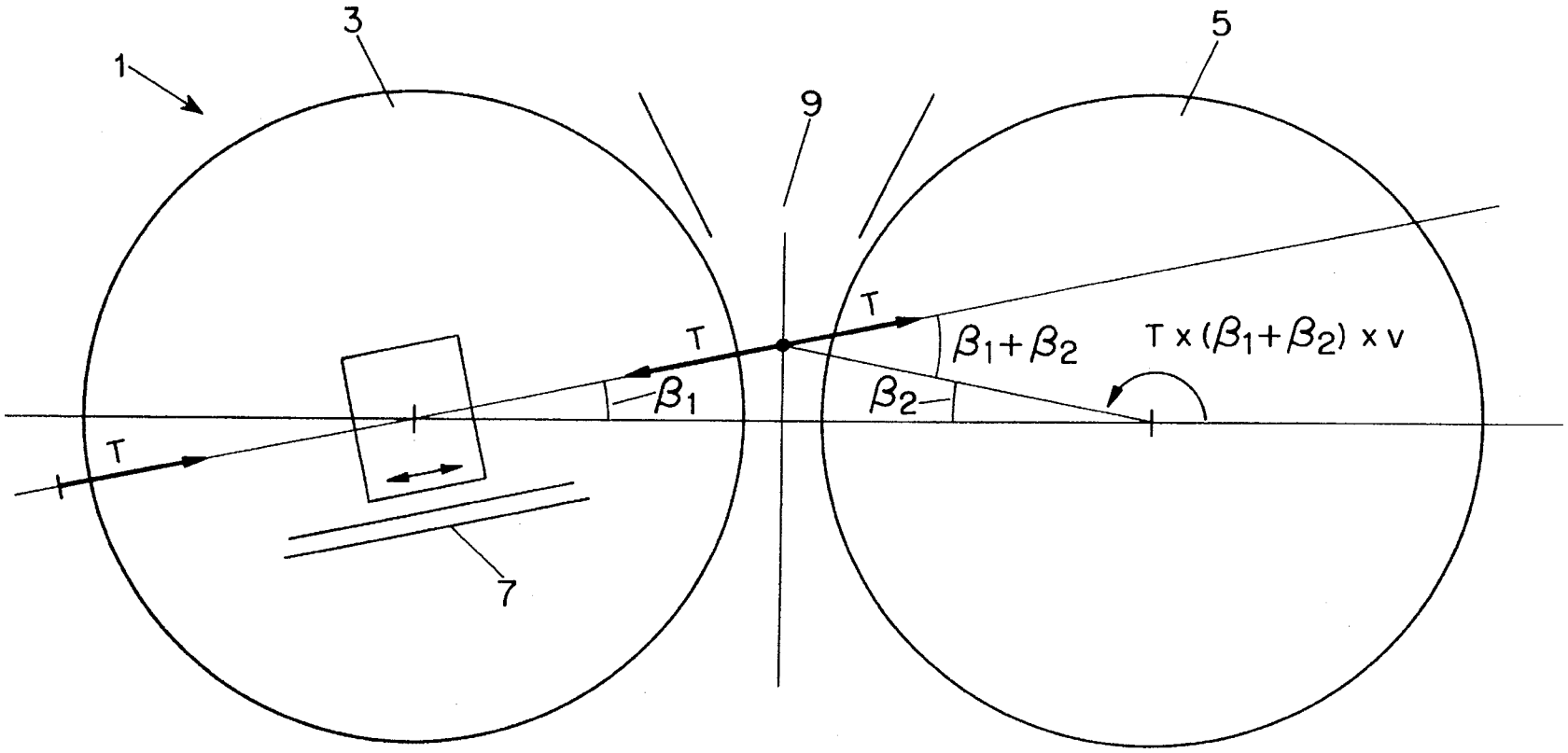

The present invention relates to a roller press (hereinafter referred to as of the kind described) for the grinding of granular material, and consisting of two or more rollers adjacent ones of which rotate in opposite directions, and where at least between two adjacent rollers, of which at least one is displaceable in a guideway, a grinding bed is formed, and where only one of the two rollers is connected to a driving means.

Roller presses of this kink are well-known and are often used in preference to roller presses incorporating driving means for each roller given that the roller press installation is simpler and less expensive when not all of the rollers are connected to a driving means.

In the case of roller presses not being driven on all rollers, the static load condition is, however, unfavourable since a considerable force reaction is acting at right angles to the guideway of the displaceable roller owing to the fact that the resultant force exerted on the movable roller is not acting parallel to the guideway of the roller, as is the case for rollers incorporating driving means for all roller, hence causing it, instead, to act in a direction which is angularly displaced relatively to the guideway of the roller. This force reaction acting at right angles to the guideway of the rollers will give rise to, particularly in connection with considerable grinding pressures between the rollers, substantial mechanical stress loads at the frame of the roller press, as well as severe wear exposure of the guideway itself, when the displaceable roller is moving to and fro in response to variations in the thickness of the grinding bed.

It is the object of the present invention to provide a roller press by means of which the aforementioned disadvantages are avoided.

According to the invention this is achieved by means of a roller press of the kink described, being characterized in that the guideway for the or each of the displaceable rollers is substantially parallel to the resultant force acting on that displaceable roller.

As a result, virtually of the resultant force acting on the displaceable roller is absorbed solely by means of reaction devices, such as hydraulic cylinders or springs, which are located at the guideway of the roller.

The magnitude of the angle between the line joining the axes of the rollers and the necessary roller guideway, necessary to ensure parallelism between the resultant force on the roller and the guideway of the roller can be calculated on the basis of the following formula for rollers of equal diameter:

$$\beta=N/2\cdot T\cdot v$$

where $\beta$=angle in radians

N=power absorption in kW

T=total force in kN v=peripheral speed of roller in m/s

In the normal operating environment of the roller presses of the aforementioned kind, the angle will typically be between 0.02 and 0.10, preferably between 0.03 and 0.07.

In embodiments of roller presses where the weight of the displaceable roller and its bearing housings is at least partially carried by the guideway, this weight will contribute marginally to the direction of the resultant force acting on the displaceable roller and the angular orientation of the guideway will be selected accordingly such that the resultant force is substantially parallel to the guideway.

Figure 2:
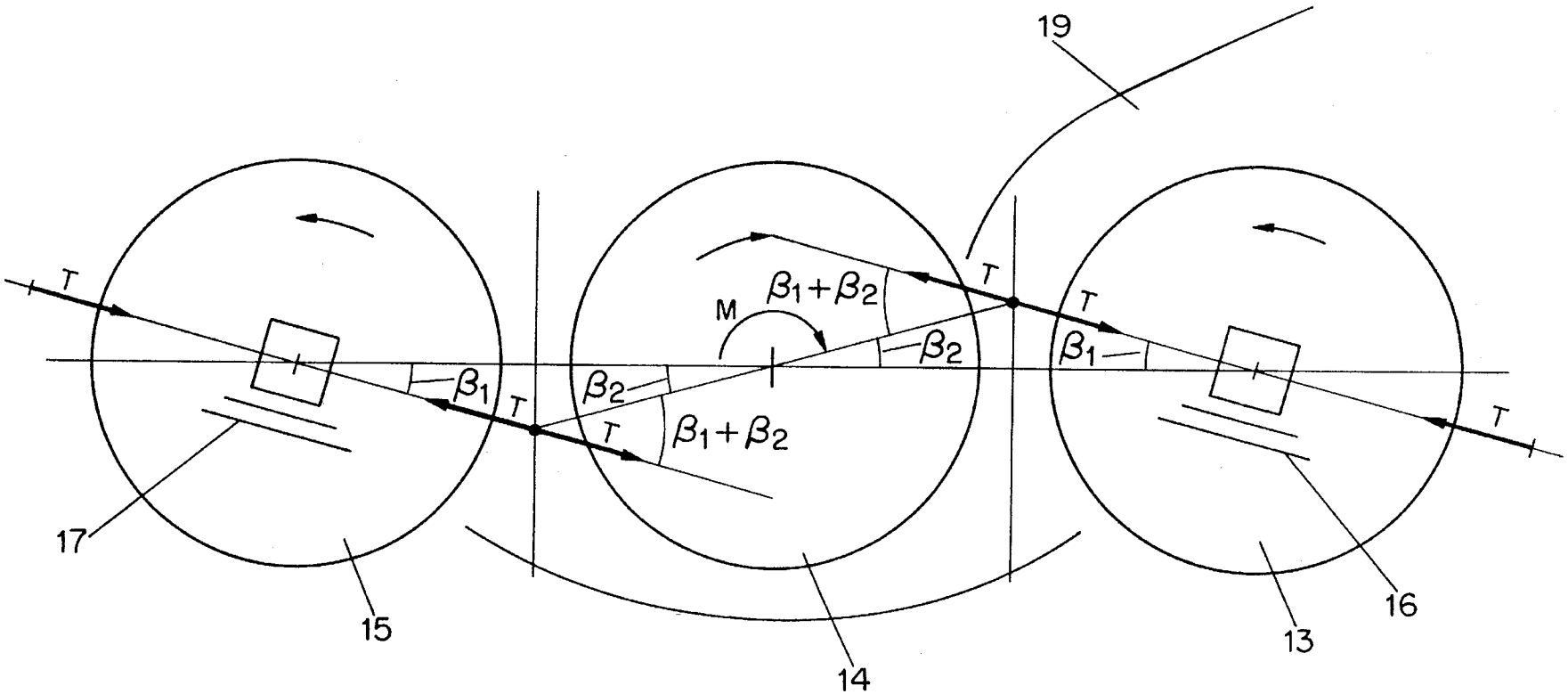

The invention will now be described in further detail with reference to the accompanying diagrammatical drawings, in which:

FIG. 1 shows a first embodiment of the roller press according to the invention; and FIG. 2 shows a second embodiment of the roller press according to the invention.

FIG. 1 shows a roller press 1 comprising two oppositely rotating rollers 3 and 5 of equal diameter. The roller 3 is displaceably support in a guideway 7, whereas the roller 5 is firmly supported and connected to a not shown driving means. During roller press operation, material is charged via a feed shaft 9, hence forming between the rollers 3, 5 is grinding bed which is ground subject to the compressive stress from the rollers. The driven roller 5 is supplied with the force T $(\beta_1+\beta_2)$v which in the illustrated force diagram generates the reaction forces T which relative to the connecting line between the centres of the rollers will be concentrated at the angle $\beta_1$. In the example shown, the angles $\beta_1$ and $\beta_2$ are of equal size since the rollers are of the same size. According to the invention the guideway 7 of the roller 3 has been oriented so that the reaction force T is parallel hereto and therefore it will not produce an angular component force which must be absorbed by the guideway 7. Virtually all of the force is absorbed by means of not shown devices, such as hydraulic cylinders or springs. In an alternative embodiment, the roller 5 may also be displaceably supported in a not shown guideway, in which case this guideway must also be oriented so that it is parallel to the guideway 7.

FIG. 2 shows a roller press 11 comprising three rollers 13, 14 and 15 of equal diameter. The rollers 13 and 15 are displaceably supported in separate guideways 16 and 17, whereas the roller 14 is firmly supported and connected to a not shown driving means. During roller press operation, material is charged via a feed shaft 19, hence forming between the rollers 13 and 14 a grinding bed which is ground by means of the compressive stress from the rollers. The material is subsequently passed on for additional grinding between the rollers 14 and 15. In similarity with the embodiment illustrated in FIG. 1, the torque on the stationary roller 14 will result in the reaction forces T on the displaceable rollers 13 and 15. As indicated in the force diagram, the reaction forces are concentrated at the angle $\beta_1$ relative to the connecting line between the centres of the rollers. According to the invention the guideways 16 and 17 of the rollers have been displaced so that the reaction force T is parallel hereto, and therefore it will not produce an angular force component which must be absorbed by the guideways. Virtually all of the force is absorbed by means of not shown devices, such as hydraulic cylinders or springs.

I claim:

1. A roller press for grinding granular material, said roller press comprising at least two rollers, wherein each roller rotates in a direction opposite to the rotational direction of each adjacent roller thereby forming a grinding bed between each two adjacent rollers, at least one of said rollers being displaceable in a guideway, wherein only one of any two adjacent rollers is connected to and driven by a driving means thereby imparting a resultant force on the non-driven roller, said guideway for said at least one displaceable roller being oriented to permit movement of the displaceable roller in a direction substantially parallel to the direction of said resultant force.

2. A roller press according to claim 1, comprising two rollers having substantially the same diameter and wherein the angle between the guideway and the line joining the axes of the two rollers is between 0.02 and 0.10 radian.

3. A roller press according to claim 2, in which the angle is between 0.03 and 0.07 radian.

4. A roller press according to claim 1, wherein the direction of said resultant force on the displaceable roller, expressed in radians from a straight line connecting the axes of two adjacent rollers, is calculated as follows:

$\beta = N/2 \cdot T \cdot v$ where $\beta$–angle in radians

N=force absorption in kW

T=total force in kN v=peripheral speed of roller in m/s.

* * * * *